US007266338B2

(12) United States Patent
Baek

(10) Patent No.: US 7,266,338 B2
(45) Date of Patent: Sep. 4, 2007

(54) WASTE TONER PULVERIZING APPARATUS AND TONER CARTRIDGE WITH THE SAME

(75) Inventor: Chung-guk Baek, Suwon-si (KR)

(73) Assignee: Samsung Electronics, Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/269,714

(22) Filed: Nov. 9, 2005

(65) Prior Publication Data

US 2006/0165451 A1 Jul. 27, 2006

(30) Foreign Application Priority Data

Jan. 21, 2005 (KR) ..... 10-2005-0005678

(51) Int. Cl.
*G03G 21/00* (2006.01)

(52) U.S. Cl. ..... 399/350; 399/358

(58) Field of Classification Search ..... 399/350, 399/358

See application file for complete search history.

(56) References Cited

U.S. PATENT DOCUMENTS

| | | | | |
|---|---|---|---|---|
| 4,999,678 | A * | 3/1991 | Tange | 399/348 |
| 6,463,254 | B1 * | 10/2002 | Maul et al. | 399/350 |
| 2004/0197122 | A1 * | 10/2004 | Nakano et al. | 399/350 |
| 2004/0258441 | A1 * | 12/2004 | Park et al. | 399/350 |

FOREIGN PATENT DOCUMENTS

| | | | |
|---|---|---|---|
| JP | 58158675 | A * | 9/1983 |
| JP | 02-217882 | | 8/1990 |
| JP | 03-023483 | | 1/1991 |
| JP | 03-153288 | | 7/1991 |
| JP | 06-130865 | | 5/1994 |
| JP | 2002-006712 | | 1/2002 |
| JP | 2002006712 | A * | 1/2002 |
| KR | 0134171 | | 12/1997 |
| KR | 0136218 | | 1/1999 |

* cited by examiner

*Primary Examiner*—David M. Gray
*Assistant Examiner*—Bryan Ready
(74) *Attorney, Agent, or Firm*—Roylance, Abrams, Berdo & Goodman, L.L.P.

(57) ABSTRACT

A waste toner pulverizing apparatus and a toner cartridge with the same prevents waste toner removed from a surface of a photosensitive drum by a cleaning blade from accumulating at a front end of the cleaning blade. The waste toner pulverizing apparatus in accordance with an exemplary embodiment of the present invention includes a waste pulverizing member that is spaced apart from a front end of a cleaning blade that contacts the surface of the photosensitive drum in a longitudinal direction, the waste pulverizing member not contacting the surface of the photosensitive drum, and a pulverizing member driving unit that makes the waste toner pulverizing member reciprocate in an axial direction of the photosensitive drum.

20 Claims, 6 Drawing Sheets

WASTE TONER PULVERIZING APPARATUS AND TONER CARTRIDGE WITH THE SAME

CROSS-REFERENCE TO RELATED APPLICATIONS

This application claims the benefit under 35 U.S.C. §119 (a) of Korean Patent Application No. 2005-5678, filed on Jan. 21, 2005, the entire content of which is hereby incorporated by reference.

BACKGROUND OF THE INVENTION

1. Field of the Invention

The present invention relates to an electrophotographic type image forming apparatus. More particularly, the present invention relates to a waste toner pulverizing apparatus and a toner cartridge with the same which pulverizes waste toner accumulated between a photosensitive drum and a front end of a cleaning blade.

2. Description of the Related Art

In general, an electrophotographic type image forming apparatus is a printing apparatus in which an electrostatic latent image formed on a surface of a photosensitive drum is developed by a toner to form a visible image. The developed visible image is then transferred to a printing media. After the visible image is transferred to the printing media, any toner that is not transferred to the printing media remains on the surface of the photosensitive drum. The remaining toner is waste toner that can not be used for developing new electrostatic latent images, and so the waste toner needs to be removed from the surface of the photosensitive drum. Accordingly, an electrophotographic type image forming apparatus includes a waste toner removing unit which can remove such waste toner.

Referring to FIG. 1, a waste toner removing unit 1 comprises a cleaning blade 3, a waste toner housing 5 and a waste toner transporting plate 7.

The cleaning blade 3 is installed so that it contacts the surface of a photosensitive drum 10 in an axial direction, and the cleaning blade 3 removes the waste toner remaining on the surface of the photosensitive drum 10. In general, the cleaning blade 3 has a rectangular plate shape and is made from an elastic material such as rubber.

The waste toner housing 5 receives the waste toner which is removed from a surface of the photosensitive drum 10 by the cleaning blade 3. The waste toner housing 5 is provided below the waste toner transporting plate 7 at one side of the cleaning blade 3 and has a size and shape for receiving the waste toner that falls from the waste toner transporting plate 7.

The waste toner transporting plate 7 is provided above the cleaning blade 3 and guides the waste toner removed from the surface of the photosensitive drum 10 by a front end 3*a* of the cleaning blade 3 to the waste toner housing 5. The waste toner transporting plate 7 has a thin plate shape, such as plastic film. The waste toner transporting plate 7 can be vibrated above the cleaning blade 3 in an axial direction of the photosensitive drum 10 (that is, in a direction perpendicular to a paper in FIG. 1) by a separate driving means (not shown). When the waste toner transporting plate 7 is vibrated from side to side like this, the waste toner removed by the cleaning blade 3 does not accumulate on the waste toner transporting plate 7 and is received smoothly in the waste toner housing 5.

In the waste toner removing unit 1 described above, once the photosensitive drum 10 is rotated, the waste toner remaining on the surface of the photosensitive drum 10 is removed from the surface of the photosensitive drum 10 by the front end 3*a* of the cleaning blade 3 and then transported to an upper side of the waste toner transporting plate 7. The waste toner transported to an upper side of the waste toner transporting plate 7 is received in the waste toner housing 5 by gravity or by vibration.

In this conventional waste toner removing unit 1, a step is formed between the front end 3*a* of the cleaning blade 3 and the surface of the photosensitive drum 10. In other words, waste toner removed from the surface of the photosensitive drum 10 accumulates at the front end 3*a* of the cleaning blade 3 as indicated by reference numeral 9 in FIG. 1. In particular, when a user leaves the image forming apparatus for a long time without performing a printing operation or when the image forming apparatus is placed in a low temperature and low humidity environment, accumulation of the waste toner becomes excessive. When the waste toner accumulates as described above, since the waste toner is not removed completely from the surface of the photosensitive drum 10, the surface of the photosensitive drum 10 is not cleaned very well. This causes staining of images on the printed media.

Also, when the waste toner transporting plate 7 located above the cleaning blade 3 is vibrated from side to side, it is impossible to prevent the waste toner from accumulating at the front end 3*a* of the cleaning blade 3 as described above. Therefore, the media on which the image is formed may be contaminated due to incomplete cleaning of the surface of the photosensitive drum 10. Accordingly, there is a need for an improved apparatus for removing waste toner from the surface of a photo sensitive drum.

SUMMARY OF THE INVENTION

An aspect of the present invention is to solve at least the above problems and/or disadvantages and to provide at least the advantages described below. Accordingly, an aspect of the present invention is to provide a waste toner pulverizing apparatus and a toner cartridge with the same which can prevent waste toner removed from a surface of a photosensitive drum by a cleaning blade from accumulating at a front end of the cleaning blade.

In an exemplary embodiment of the present invention, a waste toner pulverizing apparatus comprises a waste pulverizing member and a pulverizing member driving unit. The waste pulverizing member is spaced apart from a front end of a cleaning blade which contacts the surface of the photosensitive drum in a longitudinal direction. The waste pulverizing member does not contact the surface of the photosensitive drum. The pulverizing member driving unit makes the waste toner pulverizing member reciprocate in an axial direction of the photosensitive drum.

The waste toner pulverizing member is preferably formed with a brush or is formed from an elastic material.

The pulverizing member driving unit may comprise a cam follower formed at one side of the waste toner pulverizing member, an elastic member elastically supporting the other side of the waste toner pulverizing member, and a driving cam rotatably installed and having an inclined surface to contact the cam follower. The waste toner pulverizing member is reciprocated when the driving cam is rotated.

According to another exemplary embodiment of the present invention, the waste toner pulverizing apparatus comprises a toner transporting plate placed on a cleaning blade that contacts the surface of a photosensitive drum in a longitudinal direction, a waste toner pulverizing member that is spaced apart from a front end of a cleaning blade at a front end portion of the toner transporting plate and which does not contact the surface of the photosensitive drum, and a transporting plate driving unit that makes the toner transporting plate reciprocate linearly on the cleaning blade.

The transporting plate driving unit may comprise a vibrating shaft at which the toner plating plate is installed, a cam follower formed at one end of the vibrating shaft, an elastic member elastically supporting the other end of the vibrating shaft, and a driving cam installed rotatably and having an inclined surface to contact the cam follower. The toner transporting plate is reciprocated when the driving cam is rotated.

According to yet another exemplary embodiment of the present invention, a toner cartridge comprises a photosensitive drum on which an electrostatic latent image is formed. A developing unit supplies toner to the photosensitive drum to develop the electrostatic latent image. A waste toner removing unit includes a cleaning blade for removing waste toner remaining on the surface of the photosensitive drum and a waste toner housing for receiving the removed waste toner. A waste toner pulverizing apparatus comprises a toner transporting plate placed on the cleaning blade and the waste toner housing, a waste toner pulverizing member that is spaced apart from a front end of a cleaning blade at an front end portion of the toner transporting plate and that does not contact the surface of the photosensitive drum, and a transporting plate driving unit that makes the toner transporting plate reciprocate linearly on the cleaning blade.

According to the exemplary embodiments of the waste toner pulverizing apparatus and the toner cartridge having the same as described above, the waste toner pulverizing member is vibrated from side to side to pulverize the waste toner separated by the cleaning blade. Therefore, it is possible to prevent the waste toner removed from the surface of the photosensitive drum by the cleaning blade from accumulating at the front end of the cleaning blade.

Furthermore, even if a user leaves the image forming apparatus for a long time without performing a printing operation, or the image forming apparatus is placed in a low temperature and low humidity environment, waste toner does not accumulate at a front end of the cleaning blade.

Accordingly, once a printing process is performed by the image forming apparatus using the waste toner pulverizing apparatus or the toner cartridge according to the present invention, image contamination of the media caused by an incomplete cleaning of a surface of the photosensitive drum is minimized.

BRIEF DESCRIPTION OF THE DRAWINGS

The above and other objects, features, and advantages of certain embodiments of the present invention will be more apparent from the following description taken in conjunction with the accompanying drawings, in which.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
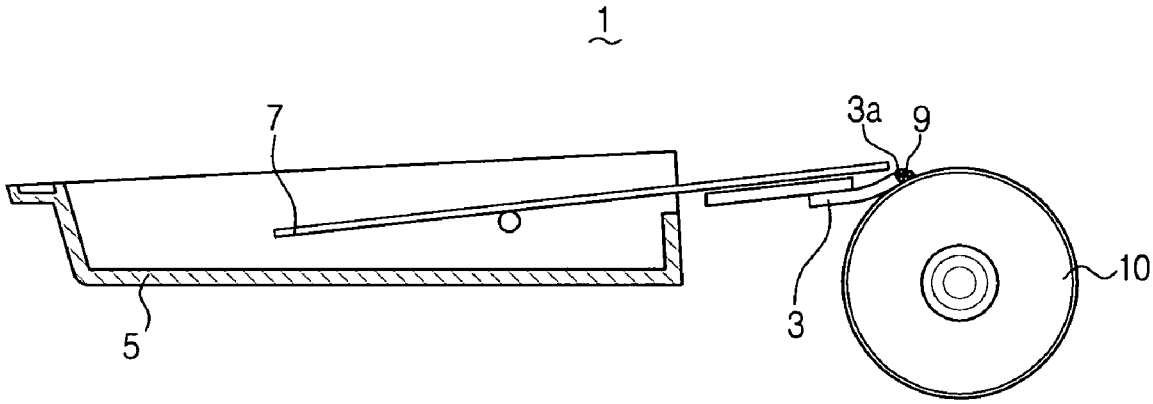
FIG. 1 (PRIOR ART)
FIG. 1 is a view showing how waste toner is removed by a cleaning blade of a conventional waste toner removing unit.
Figure 2:
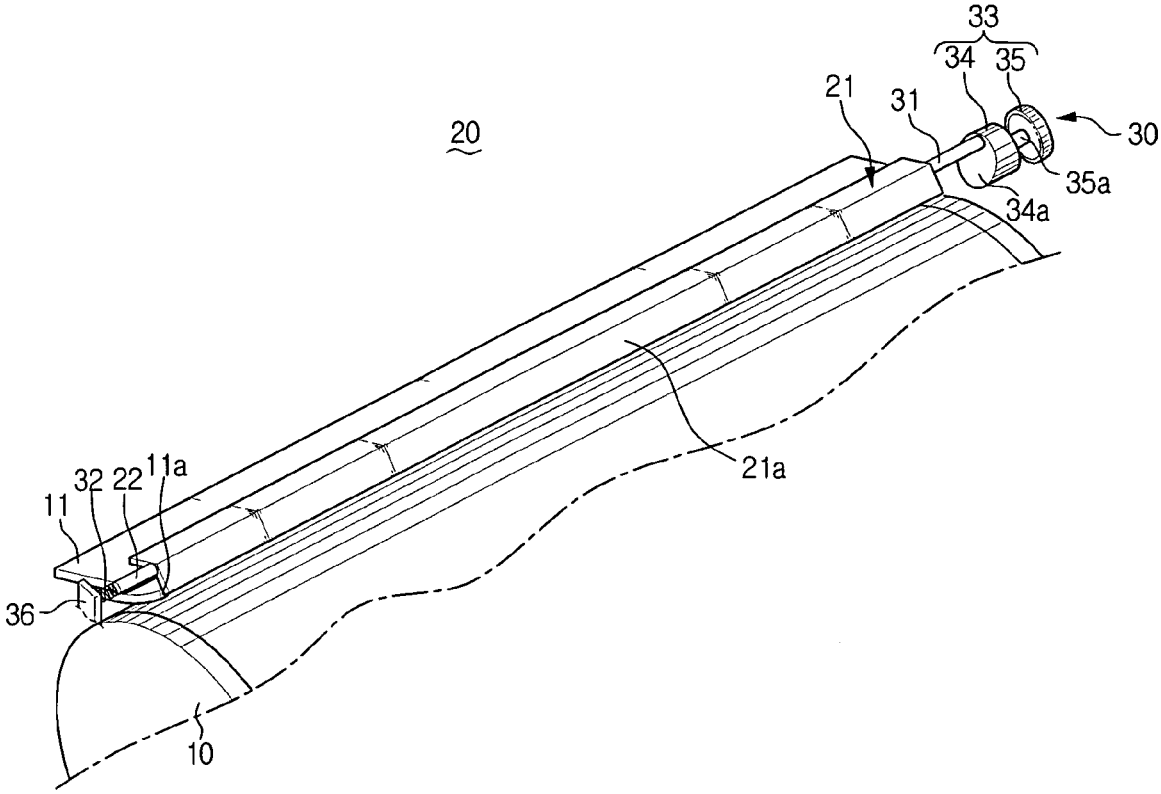
FIG. 2 is a perspective view of a waste toner pulverizing apparatus according to a first exemplary embodiment of the present invention.

Referring to FIG. 2, a waste toner pulverizing apparatus 20 according to the first exemplary embodiment of the present invention comprises a waste toner pulverizing member 21 and a pulverizing member driving unit 30.

The waste toner pulverizing member 21 is spaced apart from a front end 11*a* of a cleaning blade 11 which contacts the surface of the photosensitive drum 10 in a longitudinal direction. The waste toner pulverizing member 21 does not contact the surface of the photosensitive drum 10. The space between the waste toner pulverizing member 21 and the front end 11*a* of the cleaning blade 11 and the space between the waste toner pulverizing member 21 and the surface of the photosensitive drum 10 are experimentally determined based on the diameter of the photosensitive drum 10 and the size of the cleaning blade 11. The spaces are chosen so that the waste toner pulverizing member 21 does not obstruct the function of the cleaning blade 11 for separating the waste toner from a surface of the photosensitive drum 10 and also so that the waste toner pulverizing member 21 prevents the separated waste toner from accumulating at the front end 11*a* of the cleaning blade 11. Preferably, both side ends of the waste toner pulverizing member 21 are supported by a frame (not shown) to enable the waste toner pulverizing member 21 to reciprocate from side to side without contacting the cleaning blade 11. That is, a cam follower 31 formed at one side of the waste toner pulverizing member 21 and a supporting section 22 of an elastic member 32 formed at the other side of the waste toner pulverizing member 21 are supported by the frame (not shown). The waste toner pulverizing member 21 is preferably formed from an elastic material.

To prevent the waste toner separated from the surface of the photosensitive drum 10 from accumulating at the front end 11*a* of the cleaning blade 11, the pulverizing member driving unit 30 makes the waste toner pulverizing member 21 reciprocate in an axial direction of the photosensitive drum 10. The pulverizing member driving unit 30 comprises a cam follower 31 formed at one side of the waste toner pulverizing member 21, the elastic member 32 elastically supporting the other side of the waste toner pulverizing member 21, and a driving cam 33 rotatably installed and having an inclined surface 34*a* to contact the cam follower 31.

The driving cam 33, as shown in FIG. 2, has a cam section 34 having the inclined surface 34*a* formed at one end, and a gear 35 formed at the other end. Power is transmitted from a power transmission means which is not shown to the gear 35 to rotate the driving cam 33 on a rotational shaft 35*a*. Preferably, the power is transmitted from the power transmission means (not shown) which rotates the photosensitive drum 10 to the gear 35 of the driving cam 33. In this exemplary embodiment, the power is transmitted by a gear. If the power is transmitted by a belt, a pulley is formed at another end of the driving cam 33. The driving cam 33 is installed such that an edge of the inclined surface 34*a* of the driving cam 33 contacts the cam follower 31. Accordingly, when the driving cam 33 is rotated from a low point section to a high point section, the cam follower 31 is pushed to one side (left side in FIG. 2). The difference in height between the high point section and the low point section of the inclined surface 34*a* of the driving cam 33 defines the reciprocation stroke of the waste toner pulverizing member 21.

The elastic member 32 is installed between a fixing bracket 36 and the supporting section 22 of the waste toner pulverizing member 21 and presses the waste toner pulverizing member 21 toward the driving cam 33. Accordingly, the waste toner pulverizing member 21 can be moved by the driving cam 33 reciprocate from side to side. Preferably, a compression spring is used as the elastic member 32. Also, preferably, the fixing bracket 36 is fixed to a frame (not shown) which supports the photosensitive drum 10.

The operation of the waste toner pulverizing apparatus 20 according to the first exemplary embodiment of the present invention described above is as follows.

When the photosensitive drum 10 is rotated, the waste toner remaining on the surface of the photosensitive drum 10 is separated from the surface of the photosensitive drum 10 by the front end 11*a* of the cleaning blade 11 and gathered at the front side of the cleaning blade 11. During this time, the waste toner pulverizing member 21 reciprocates linearly (hereinafter referred to as "horizontal vibration") in a longitudinal direction of the cleaning blade 11 by the pulverizing member driving unit 30. Thus, the separated waste toner does not accumulate, but is conveyed on the waste toner pulverizing member 21. The separated waste toner is then transported along an upper surface of the cleaning blade 11 and received in the waste toner housing (not shown).

The horizontal vibration of the waste toner pulverizing member 21 caused by the pulverizing member driving unit 30 will now be described in further detail.

When the cam follower 31 of the waste toner pulverizing member 21 contacts the low point section of the inclined surface 34*a* of the driving cam 33, and the driving cam 33 is rotated by the power transmitted from the power transmission means (not shown), the cam follower 31 gradually contacts the high point section of the inclined surface 34*a*. Thus, the waste toner pulverizing member 21 is pushed in one direction (to the left side of FIG. 2). At this time, the elastic member 32 elastically supporting the waste toner pulverizing member 21 is compressed. Once the cam follower 31 passes the high point section of the inclined surface 34*a* and moves to the low point section by the continuous rotation of the driving cam 33, the waste toner pulverizing member 21 is pushed in the opposite direction (to the right side of FIG. 2) by a restitution force of the elastic member 32. That is, the waste toner pulverizing member 21 is vibrated from side to side by the driving cam 33 and the elastic member 32. The amplitude of the waste toner pulverizing member 21 vibration from side to side is the difference in height between the low point section and the high point section of the inclined surface 34*a* of the driving cam 33.

Figure 3:
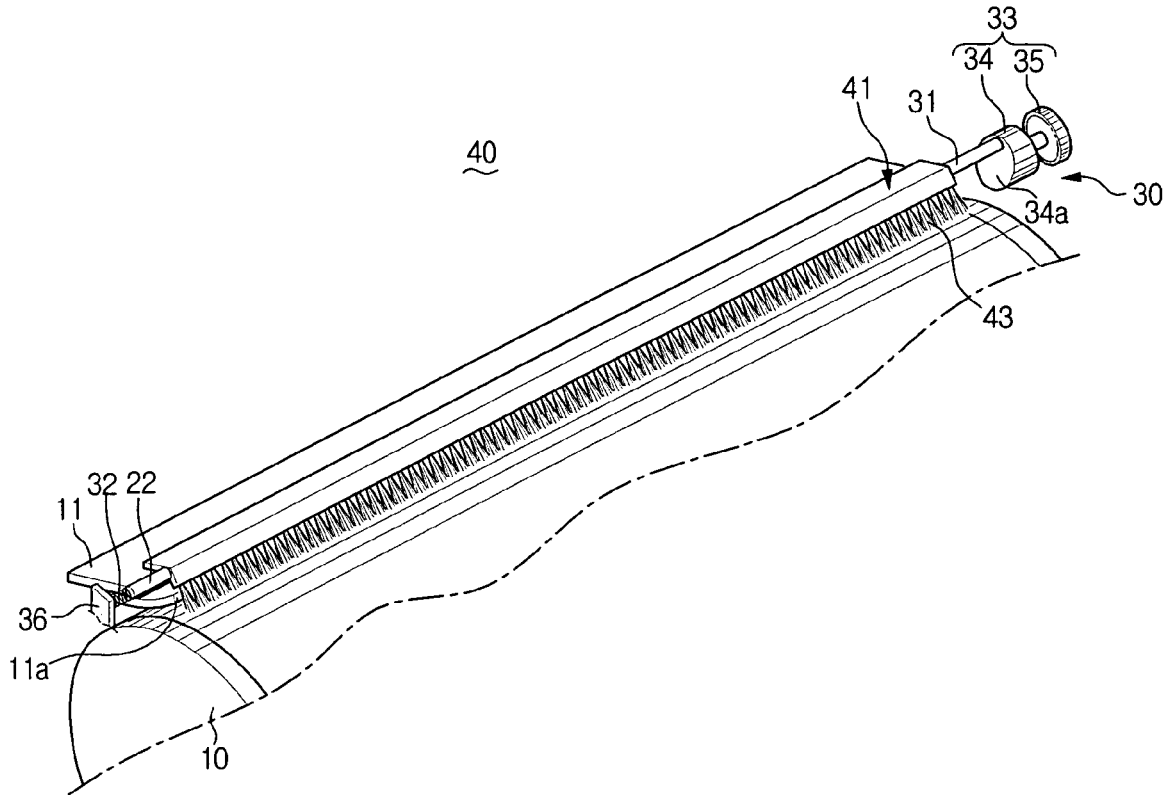
FIG. 3 is a perspective view of a waste toner pulverizing apparatus according to a second exemplary embodiment of the present invention.

A waste toner pulverizing apparatus according to a second exemplary embodiment of the present invention is described in conjunction with FIG. 3.

A waste toner pulverizing apparatus 40 according to the second embodiment of the present invention comprises a waste toner pulverizing member 41 and a pulverizing member driving unit 30.

The waste toner pulverizing member 41 is installed at a front side of the front end 11*a* of the cleaning blade 11 and prevents the waste toner separated from a surface of the photosensitive drum 10 by the cleaning blade 11 from accumulating. As shown in FIG. 3, the structure of the waste toner pulverizing member 41 is substantially the same as that of the waste toner pulverizing member 21 in the first exemplary embodiment, except that the portion 43 that faces the surface of the photosensitive drum 10 is formed with a brush shape.

The pulverizing member driving unit 30 makes the waste toner pulverizing member 41 vibrate from side to side. The structure and operation of the pulverizing member driving unit 30 is the same as that of the pulverizing member driving unit in the first exemplary embodiment, so a detailed description is not repeated for conciseness.

Figure 4:
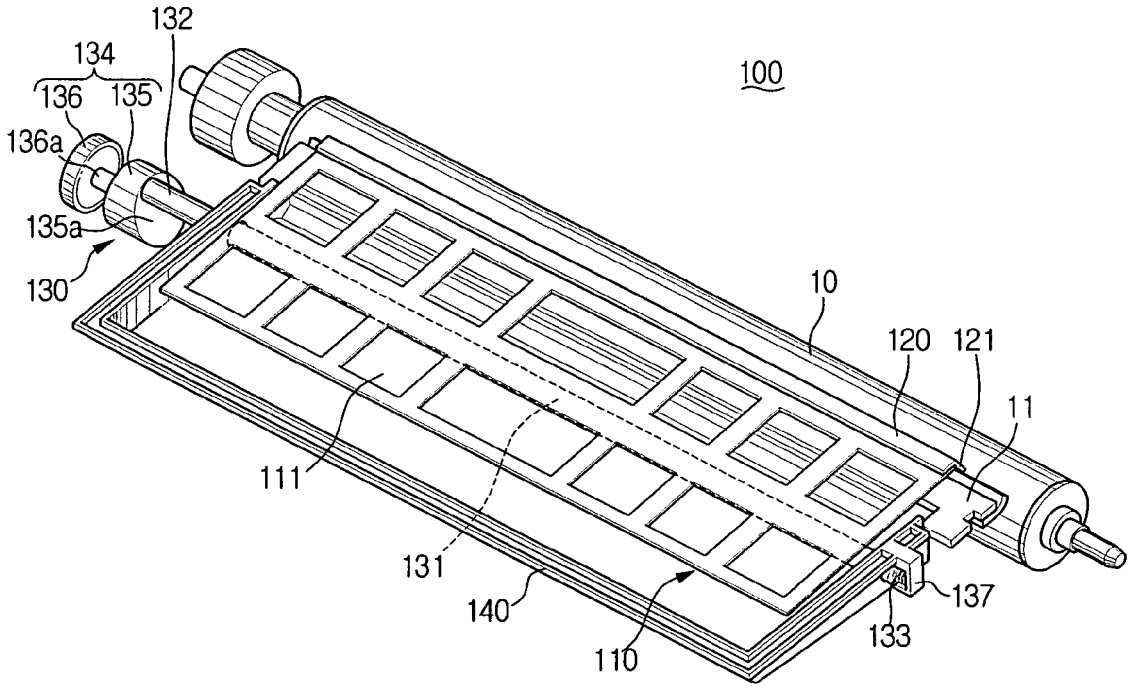
FIG. 4 is a perspective view of a waste toner pulverizing apparatus according to a third exemplary embodiment of the present invention.
Figure 5:
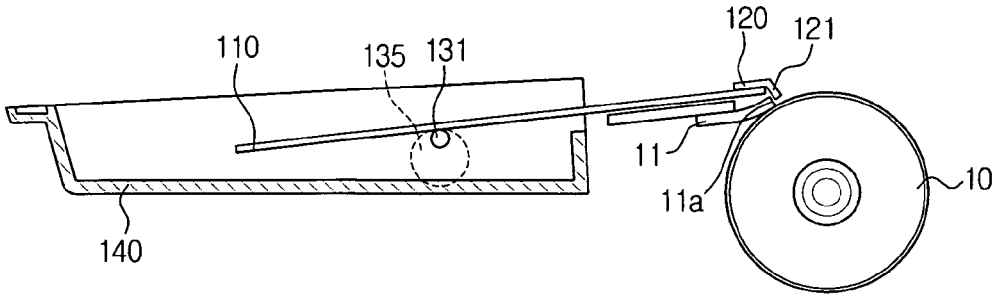
FIG. 5 is a sectional view of the waste toner pulverizing apparatus shown in FIG. 4.

A waste toner pulverizing apparatus according to a third exemplary embodiment of the present invention is described in conjunction with FIG. 4 and FIG. 5.

A waste toner pulverizing apparatus 100 according to a third exemplary embodiment of the present invention comprises a waste toner transporting plate 110, a waste toner pulverizing member 120 and a transporting plate driving unit 130.

The toner transporting plate 110 is vibrated from side to side by the transporting plate driving unit 130 to transport the waste toner separated from the photosensitive drum 10 by the cleaning blade 11. The toner transporting plate 110 is placed above the cleaning blade 11 that contacts the surface of the photosensitive 10 in a longitudinal direction and the waste toner housing 140 that is installed at one side of the cleaning blade 11. The toner transporting plate 110 is inclined downward toward the waste toner housing 140. The toner transporting plate 110 has a smaller size than that of the waste toner housing 140 so that the toner transporting plate 110 can be vibrated from side to side with a certain amplitude in the waste toner housing 140. Preferably, a plurality of through holes 111 are formed on the toner transporting plate 110 so that the transported waste toner can be received evenly in the waste toner housing 140.

At a front end portion of the toner transporting plate 110, the waste toner pulverizing member 120 is spaced apart from the front end 11*a* of the cleaning blade 11 by a certain distance and does not contact the surface of the photosensitive drum 10. The space between the waste toner pulverizing member 120 and the front end 11*a* of the cleaning blade 11 and the space between the waste toner pulverizing member 120 and the surface of the photosensitive drum 10 are experimentally determined, like the first exemplary embodiment described above. Preferably, the waste toner pulverizing member 120 is formed from an elastic material. A portion 121 of the waste toner pulverizing member 120 that faces the surface of the photosensitive 10 can be formed with a brush shape like the second exemplary embodiment.

The transporting plate driving unit 130 makes the toner transporting plate 110 reciprocate linearly, that is, vibrate from side to side on the cleaning blade 11. The transporting plate driving unit 130 comprises a vibrating shaft 131, a cam follower 132, an elastic member 133 and a driving cam 134.

The vibrating shaft 131 passes through both side walls of the waste toner housing 140 substantially parallel with the cleaning blade 11 and is installed such that the vibrating shaft can be vibrated inside the waste toner housing 140. The toner transporting plate 110 is fixed to an upper side of the vibrating shaft 131. The cam follower 132 contacts the driving cam 134 formed at one end of the vibrating shaft 131, and the other end is elastically supported by the elastic member 133.

The elastic member 133 is supported by a fixing section 137 installed at the waste toner housing 140 and presses the vibrating shaft 131 toward the driving cam 134. Accordingly, the toner transporting plate 110 is moved to one side by the driving cam 134 and can be reciprocated from side to side. Preferably, a compression spring is used as the elastic member 133.

In the driving cam 134, as shown in FIG. 4, a cam section 135 having the inclined surface 135*a* is formed at one end, and a gear 136 is formed at the other end. Power is transmitted from a power transmission means which is not shown to the gear 136 to rotate the driving cam 134 on a rotational shaft 136*a*. Preferably, the power is transmitted from the power transmission means (not shown) which rotates the photosensitive drum 10 to the gear 136 of the driving cam 134. In this exemplary embodiment, the power is transmitted by a gear. When the power is transmitted by a belt, a pulley is formed at another end of the driving cam 134. The driving cam 134 is installed such that an edge of the inclined surface 135*a* of the driving cam 134 contacts the cam follower 132. Accordingly, once the driving cam 134 is rotated from a low point section to a high point section, the cam follower 132 is pushed to one side (right side in FIG. 4). Due to the height difference between the high point section and the low point section of the inclined surface 135*a* of the driving cam 134, the toner transporting plate 110 is subjected to a stroke, that is, it is vibrated from side to side.

The operation of the waste toner pulverizing apparatus according to the third exemplary embodiment of the present invention as described above is described in conjunction with FIG. 4 and FIG. 5.

When the photosensitive drum 10 is rotated, after the developed visible image is transferred to the printing medium, the waste toner remaining on the surface of the photosensitive drum 10 is separated from the surface of the photosensitive drum 10 by the front end 11*a* of the cleaning blade 11 and gathered at a front side of the cleaning blade 11. At this time, since the waste toner pulverizing member 120 is vibrated from side to side in a longitudinal direction of the cleaning blade 11 together with the toner transporting plate 110, the separated waste toner does not accumulate, but instead is conveyed on the waste toner pulverizing member 120. The separated waste toner is then transported along the toner transporting plate 110 and received in the waste toner housing 140.

The horizontal vibration of the toner transporting plate 110 provided in the waste toner pulverizing member 120 caused by the transporting plate driving unit 130 is described in detail as follows.

When the cam follower 132 of the vibrating shaft 131 contacts the low point section of the inclined surface 135*a* of the driving cam 134, and the driving cam 134 is rotated by power transmitted from the power transmission means (not shown), the cam follower 132 gradually contacts the high point section of the inclined surface 135*a*, and the vibrating shaft 131 is pushed in one direction (to the right side of FIG. 4). At this time, the elastic member 133 elastically supporting the vibrating shaft 131 is compressed. Once the cam follower 132 passes the high point section of the inclined surface 135*a* and moves to the low point section due to the continuous rotation of the driving cam 134, the vibrating shaft 131 is pushed in the opposite direction (to the left side of FIG. 4) by a restitution force of the elastic member 133. That is, the vibrating shaft 131 is vibrated from side to side by the driving cam 134 and the elastic member 133. Accordingly, the toner transporting plate 110 provided above the vibrating shaft 131 also vibrates from side to side. Once the toner transporting plate 110 vibrates from side to side, the waste toner pulverizing member 120 provided at a front end portion of the toner transporting plate 110 is also vibrated from side to side. Thus, the waste toner separated by the cleaning blade 11 does not accumulate. At this time, the waste toner pulverizing member 120 vibrates from side to side with an amplitude that is the difference in height between the low point section and the high point section of the inclined surface 135*a* of the driving cam 134.

Figure 6:
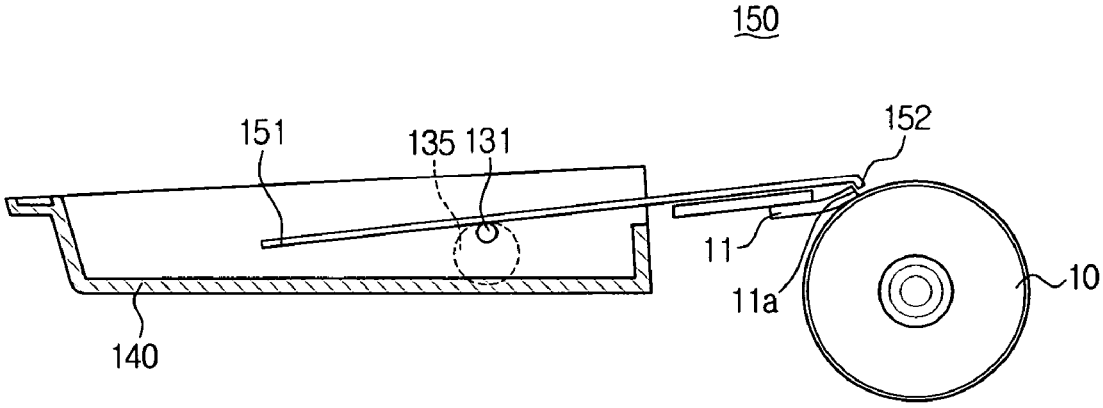
FIG. 6 is a sectional view of a waste toner pulverizing apparatus according to a fourth exemplary embodiment of the present invention.

A waste toner pulverizing apparatus according to a fourth exemplary embodiment of the present invention is illustrated in FIG. 6.

The waste toner pulverizing apparatus 150 according to the fourth exemplary embodiment of the present invention comprises a toner transporting plate 151, a waste toner pulverizing member 152, and a transporting plate driving unit 130 (see FIG. 4). The waste toner pulverizing apparatus 150 is the same as the waste toner pulverizing apparatus 100 according to the third exemplary embodiments except that the toner transporting plate 151 and the waste toner pulverizing member 152 are integrally formed with each other in this embodiment. In an exemplary embodiment, the toner transporting plate 151 can be formed integrally with the waste toner pulverizing member 152 by bending a front portion of the toner transporting plate 151. Other methods such as extruding or injection molding and the like can also be used.

Hereinafter, one embodiment of a toner cartridge having a waste toner pulverizing apparatus according to an exemplary embodiment of the present invention is described in conjunction with FIG. 7.

Figure 7:
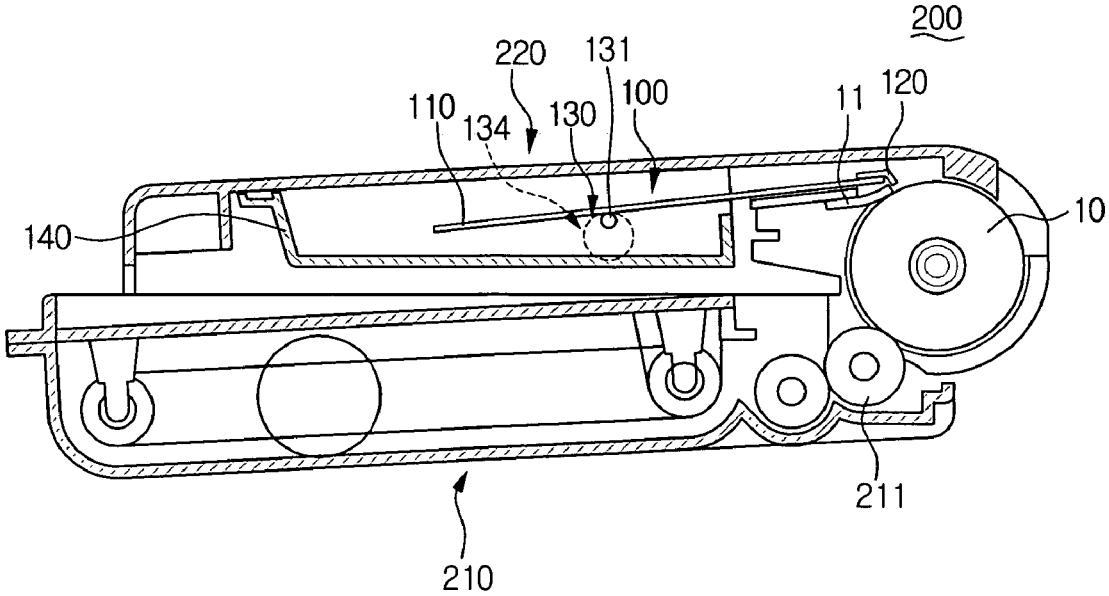
FIG. 7 is a sectional view showing an exemplary embodiment of a toner cartridge with the waste toner pulverizing apparatus according to the present invention.

Referring to FIG. 7, a toner cartridge 200 according to the present invention comprises the photosensitive drum 10, a developing unit 210 and a waste toner removing unit 220.

An electrostatic latent image is formed on the surface of the photosensitive drum 10 by a laser beam irradiated from an exposure unit (not shown), and the photosensitive drum 10 is rotated by a power transmission member (not shown).

A certain amount of toner is stored in the developing unit 210, and the toner is supplied to the photosensitive drum 10 by a developing roller 211 to develop the electrostatic latent image formed on the surface of the photosensitive drum 10.

The waste toner removing unit 220 removes the waste toner remaining on the surface of the photosensitive drum 10 and comprises the cleaning blade 11, the waste toner pulverizing apparatus 100 and the waste toner housing 140.

The cleaning blade 11 contacts the surface of the photosensitive drum 10 and removes the waste toner remaining on a surface of the photosensitive drum 10.

The waste toner pulverizing apparatus 100 comprises the toner transporting plate 110, the waste toner pulverizing member 120 and the transporting plate driving unit 130. The structure and operation of each of structural elements is the same as those of each element in the third exemplary embodiment. Therefore, a detailed description is not repeated for conciseness.

The waste toner housing 140 receives the waste toner pulverized by the waste toner pulverizing member 120 and transported by the toner transporting plate 110, and is provided with the toner transporting plate 110 and the vibrating shaft 131 installed therein. Accordingly, shaft holes through which the vibrating shaft 131 can be reciprocated are formed on both side walls of the waste toner housing 140. These shaft holes are sealed to prevent the waste toner from leaking when the vibrating shaft 131 reciprocates. A fixing section 137 is formed on one side wall of the waste toner housing 140 to support the elastic member 133 (see FIG. 4).

The operation of the toner cartridge 200 will now be described in conjunction with FIG. 4 and FIG. 7.

Once the printing process is initiated, the laser beam irradiates the photosensitive drum 10 to form the electrostatic latent image on the photosensitive drum 10. Once the photosensitive drum 10 is rotated, the electrostatic latent image formed on the photosensitive drum 10 is developed by the toner supplied by the developing roller 211 of the developing unit 210, and so a visible image is formed. The photosensitive drum 10 rotates continuously, and the visible image is transferred to the printing medium by a transferring roller (not shown). After the visible image is transferred, some of the toner which is not transferred remains on the surface of the photosensitive drum 10 as waste toner. This waste toner is separated from the surface of the photosensitive drum 10 by the cleaning blade 11. Since the separated waste toner is pulverized by the waste toner pulverizing member 120 which is vibrated from side to side, the waste toner does not accumulate at the front end 11*a* of the cleaning blade 11, but is transported to the top side of the toner transporting plate 110. At this time, since the toner transporting plate 110 is inclined downward toward the waste toner housing 140 and vibrated from side to side by the driving cam 134 and the vibrating shaft 131, the waste toner transported on top of the toner transporting plate 110 is received smoothly in the waste toner housing 140.

An exemplary embodiment of an image forming apparatus using the toner cartridge 200 provided with the waste toner pulverizing apparatus 100 as described above is shown in FIG. 8.

Figure 8:
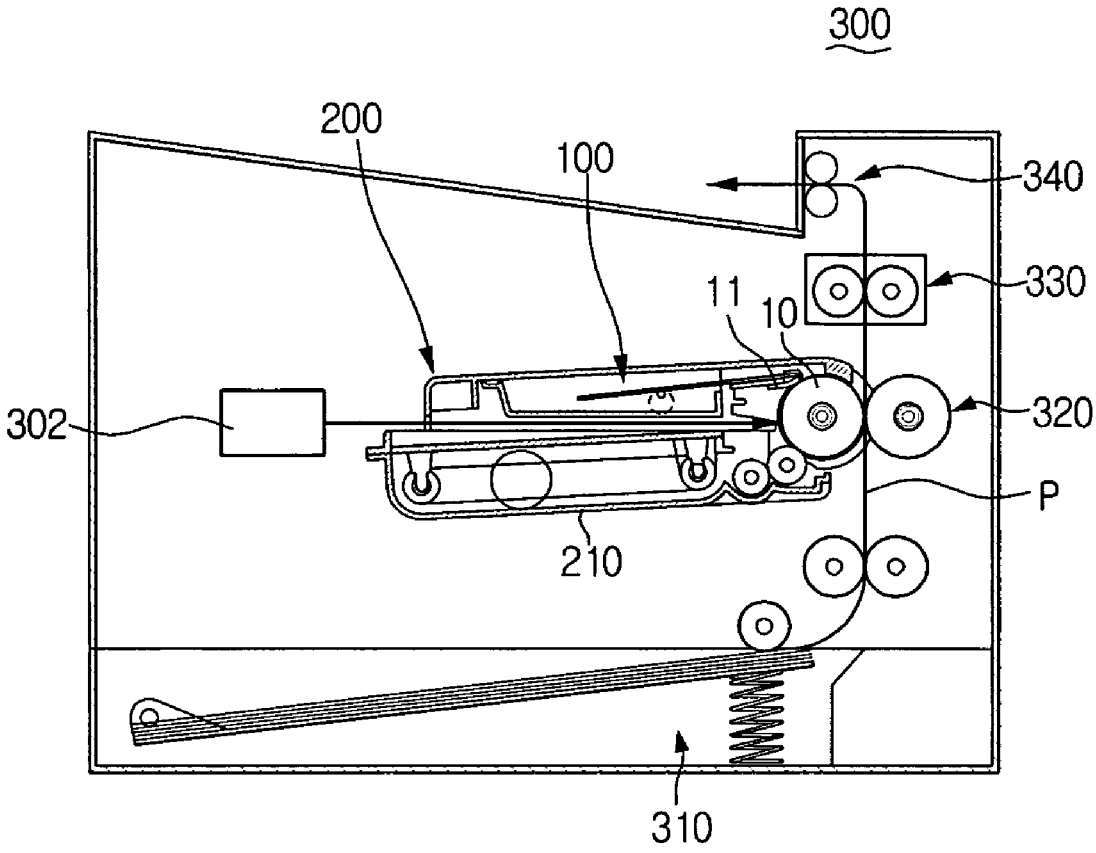
FIG. 8 is a view schematically showing an exemplary embodiment of an image forming apparatus using the toner cartridge according to the present invention.

Referring to FIG. 8, an image forming apparatus 300 comprises a dispensing unit 310 for storing printing media P and dispensing the printing medium one by one, the toner cartridge 200 for forming the image corresponding to printing data, a transferring roller 320 for transferring the image formed on the photosensitive drum 10 of the toner cartridge 200 to the printing medium P transported from the dispensing unit 310, a fixing unit 330 for fixing the image transferred to the printing medium P, and a discharging unit 340 for discharging the printing medium P on which the image is fixed outside of the apparatus.

Once the image forming apparatus 300 receives a printing command, the exposure unit 302 irradiates the laser beam corresponding to the printing data to form the electrostatic latent image on the surface of the photosensitive drum 10 of the toner cartridge 200. Then, the electrostatic latent image is developed by the developing unit 210 of the toner cartridge 200 to form the visible image, and the formed visible image is transferred to the printing medium P by the transferring roller 320. After the image is transferred to the printing medium P, the waste toner remaining on the surface of the photosensitive drum 10 is removed by the cleaning blade 221. The removed waste toner does not accumulate at the front end 11*a* of the cleaning blade 11 due to the waste toner pulverizing apparatus 100 as described above, but instead is received in the waste toner housing 140. The printing medium P on which the image is transferred is passed through the fixing unit 330 to fix the image to the printing medium P, and then the printing medium P to which the image is fixed is discharged outside by the discharging unit 340.

Although the present invention has been shown and described with reference to certain embodiments, it will be understood by those skilled in the art that various changes and modifications in form and details may be made thereto without departing from the scope and spirit of the present invention, as defined by the appended claims.

What is claimed is:

1. A waste toner pulverizing apparatus, comprising:

a waste pulverizing member that is spaced apart from a front end of a cleaning blade that contacts a surface of a photosensitive drum in a longitudinal direction, the waste pulverizing member not contacting the surface of the photosensitive drum; and a pulverizing member driving unit that makes the waste toner pulverizing member reciprocate in an axial direction of the photosensitive drum.

2. The waste toner pulverizing apparatus according to claim 1, wherein the waste toner pulverizing member comprises a brush.

3. The waste toner pulverizing apparatus according to claim 1, wherein the waste toner pulverizing member comprises an elastic material.

4. The waste toner pulverizing apparatus according to claim 1, wherein the pulverizing member driving unit includes:

a cam follower formed at one side of the waste toner pulverizing member;

an elastic member for elastically supporting the other side of the waste toner pulverizing member; and a driving cam rotatably installed and having an inclined surface that contacts the cam follower, the waste toner pulverizing member being reciprocated when the driving cam rotates.

5. A waste toner pulverizing apparatus, comprising:

a toner transporting plate that is placed on a cleaning blade that contacts a surface of a photosensitive drum in a longitudinal direction;

a waste toner pulverizing member that is spaced apart from a front end of the cleaning blade at a front end portion of the toner transporting plate and that does not contact the surface of the photosensitive drum; and a transporting plate driving unit that makes the toner transporting plate reciprocate linearly on the cleaning blade.

6. The waste toner pulverizing apparatus according to claim 5, wherein the waste toner pulverizing member is integrally formed with the toner transporting plate.

7. The waste toner pulverizing apparatus according to claim 5, wherein the waste toner pulverizing member is a brush.

8. The waste toner pulverizing apparatus according to claim 5, wherein the waste toner pulverizing member is formed of an elastic material.

9. The waste toner pulverizing apparatus according to claim 5, wherein the transporting plate driving unit includes:

a vibrating shaft on which the toner transporting plate is installed;

a cam follower formed at one end of the vibrating shaft;

an elastic member elastically supporting the other end of the vibrating shaft; and a driving cam rotatably installed and having an inclined surface that contacts the cam follower, the toner transporting plate being reciprocated when the driving cam rotates.

10. A toner cartridge, comprising:

a photosensitive drum on which an electrostatic latent image is formed;

a developing unit that supplies toner to the photosensitive drum to develop the electrostatic latent image into a visible image;

a waste toner removing unit including a cleaning blade for removing waste toner remaining on a surface of the photosensitive drum after the visible imager is transferred and a waste toner housing for receiving the removed waste toner; and a waste toner pulverizing apparatus including a toner transporting plate placed on the cleaning blade and the waste toner housing, a waste toner pulverizing member spaced apart from a front end of a cleaning blade at a front end portion of the toner transporting plate and being separated from a surface of the photosensitive drum, and a transporting plate driving unit that makes the toner transporting plate reciprocate linearly on the cleaning blade.

11. The toner cartridge according to claim 10, wherein the waste toner pulverizing member is integrally formed with the toner transporting plate.

12. The toner cartridge according to claim 10, wherein the waste toner pulverizing member is a brush.

13. The toner cartridge according to claim 10, wherein the waste toner pulverizing member is formed of an elastic material.

14. A method of forming an image in an electrostatic image forming apparatus, comprising the steps of:

generating an electrostatic latent image on a photosensitive drum;

developing the electrostatic latent image into a visible toner image;

transferring the visible toner image onto a printing media;

separating any waste toner remaining on the photosensitive drum after the visible toner image has been transferred; and pulverizing the separated waste toner with a reciprocatingly movable pulverizing member spaced from a surface of the photosensitive drum, the pulverizing member reciprocating in an axial direction of the photosensitive drum.

15. A method according to claim 14, wherein the step of pulverizing the separated waste toner includes the step of vibrating the pulverizing member.

16. A method according to claim 15, further comprising the step of:

collecting the pulverized waste toner on a waste toner transporting plate.

17. A method according to claim 16, further comprising the step of:

vibrating the waster toner transporting plate.

18. A method according to claim 17, further comprising the step of:

collecting any waste toner that falls from the waste toner transporting plate in a waste toner housing.

19. A method according to claim 18, wherein the step of separating waste toner includes the step of scraping waste toner from the photosensitive drum with a cleaning blade.

20. A method according to claim 15, wherein the step of separating waste toner includes the step of scraping waste toner from the photosensitive drum with a cleaning blade.

* * * * *